US010210781B1

(12) United States Patent
Simons et al.

(10) Patent No.: US 10,210,781 B1
(45) Date of Patent: Feb. 19, 2019

(54) POINT OF SALE DISPLAYS

(71) Applicant: Calvin Klein, Inc., New York, NY (US)

(72) Inventors: Raf Simons, New York, NY (US); Pali Xisto Cornelsen, New York, NY (US)

(73) Assignee: Calvin Klein, Inc., New York, NY (US)

( * ) Notice: Subject to any disclaimer, the term of this patent is extended or adjusted under 35 U.S.C. 154(b) by 0 days.

(21) Appl. No.: 15/867,527

(22) Filed: Jan. 10, 2018

(51) Int. Cl.

| | |
|---|---|
| ***G09F 1/08*** | (2006.01) |
| ***G09F 23/06*** | (2006.01) |
| ***A47F 9/04*** | (2006.01) |
| ***A47F 11/06*** | (2006.01) |
| ***A47F 7/19*** | (2006.01) |
| ***A47F 5/08*** | (2006.01) |
| ***G09F 15/00*** | (2006.01) |

(52) U.S. Cl.
CPC ..... *G09F 23/06* (2013.01); *A47F 5/0815* (2013.01); *A47F 5/0838* (2013.01); *A47F 5/0853* (2013.01); *A47F 7/19* (2013.01); *A47F 9/04* (2013.01); *A47F 11/06* (2013.01); *G09F 15/0018* (2013.01); *A47F 2009/041* (2013.01); *G09F 1/08* (2013.01)

(58) Field of Classification Search
CPC ..... G09F 1/08; G09F 2005/048
USPC ..... 40/538
See application file for complete search history.

(56) References Cited

U.S. PATENT DOCUMENTS

| | | | | |
|---|---|---|---|---|
| 659,802 | A * | 10/1900 | Rohlfs | A24F 9/16 206/244 |
| 2,557,402 | A * | 6/1951 | Altheimer | G09F 1/02 40/615 |
| 3,303,938 | A | 2/1967 | Solomon | |
| 3,718,260 | A * | 2/1973 | Sharp | A47F 7/02 206/495 |
| 3,921,814 | A | 11/1975 | Solomon | |
| 5,718,344 | A | 2/1998 | Joldeson et al. | |
| 5,897,416 | A * | 4/1999 | Barrows | G09F 1/02 40/538 |
| 6,644,484 | B1 | 11/2003 | Sardis | |
| 7,306,096 | B2 * | 12/2007 | d'Auriac | B65D 73/0014 206/301 |
| 9,082,323 | B1 * | 7/2015 | Dougherty | G09F 23/06 |
| 9,215,943 | B1 * | 12/2015 | Varghese-Abraham | A47F 7/022 |
| 2006/0070276 | A1 * | 4/2006 | Clark | G09F 1/08 40/538 |
| 2007/0028493 | A1 * | 2/2007 | Flagg | G09F 7/18 40/607.14 |
| 2011/0203146 | A1 * | 8/2011 | Newcomer | G09F 1/08 40/538 |
| 2012/0037581 | A1 * | 2/2012 | Anderson | A47F 7/22 211/85.3 |
| 2013/0062299 | A1 * | 3/2013 | Beaty | A47F 5/116 211/153 |

* cited by examiner

*Primary Examiner* — Kristina N Junge
(74) *Attorney, Agent, or Firm* — Venable LLP

(57) ABSTRACT

A point of sale display including a first side with an image display having an aperture, and a second side with a backing wherein the aperture extends through the second side. A member (such as a hanger bar), onto which merchandise is held for display, may be supported by one or more point of sale displays. A member may be connected to a point of sale display by a bracket affixed thereto.

23 Claims, 25 Drawing Sheets

POINT OF SALE DISPLAYS

FIELD OF THE INVENTION

The present invention relates to innovative and novel point of sale displays.

BACKGROUND OF THE INVENTION

Garment racks are typically used by retail stores for hanging and/or displaying merchandise, including clothing, apparel, garments and other accessories. Such garment racks are known in the art; for example, U.S. Pat. Nos. 6,644,484, 5,718,344 3,921,814 and 3,303,938. These garment racks allow consumers to browse and access the merchandise available for purchase.

Nevertheless, to date, garment racks have been designed solely to function as a mechanism for displaying and holding merchandise. However, especially in large retail stores, there is a need for retailers to further differentiate their products and attract consumers to their merchandise.

SUMMARY OF THE INVENTION

One object of the invention is to provide not only an aesthetically pleasing but also a functional way to display merchandise such as clothes, garments, apparel and other accessories, including but not limited to handbags, wallets, belts, scarves, shawls, socks, and umbrellas.

Another object of the invention is to merge the concepts of advertising with product displays (or garment racks) which may attract consumers to the merchandise. Yet another object of the invention is to provide a point of sale display where merchandise is advertised and the advertised merchandise is located at or near the point of sale display so that it can be quickly and easily accessed by consumers. In accordance with the present invention, the point of sale displays provide a mechanism for marketers to display and advertise their merchandise in one place, and, more importantly, at the time that a decision to purchase is made. Thus, the point of sale displays in accordance with the invention provide a mechanism for marketers to display, advertise and, in some cases, hold their merchandise in one place, all of which occurs at the time the decision to purchase is made.

Accordingly, one aspect of the invention is a hanging point of sale display which is mountable overhead (for example, to a ceiling), with apertures and/or hooks positioned on the hanging point of sale display to exhibit items of merchandise to consumers.

In another aspect of the invention, one or more point of sale displays are supportively connected to one or more members. As used herein, a member may include but is not limited to, a hanger bar, a rod, a beam, a garment rack, shelving or combinations thereof, from which merchandise is displayed and/or held for sale, thereby providing a standalone structure. The member may be connected to the point of sale display by a flush-mounted bracket, a surface mounted bracket, a pivot joint, a hook, a hanger, a socket or another connecting device.

A member, such as a hanger bar, can be of any shape, for example, straight, curved or S-shaped. Multiple hanger bars may be connected in any configuration in the horizontal or vertical plane, for example, to provide additional hanger length or structural support. Like the hanging point of sale display discussed above, these point of sale displays may have one or more apertures and/or hooks for displaying items of merchandise to consumers. Also, a short portion of a hanger bar can extend through or otherwise project from a point of sale display, on which items of merchandise may be hung for display.

In this aspect of the invention, the point of sale display serves as a load bearing structure for the member(s) and the displayed merchandise. For example, two or more spaced-apart point of sale displays that are parallel to each other, perpendicular to each other, or in another geometrical relationship to each other, may be connected together by one or more members, such as hanger bar(s), thereby creating a standalone structure for advertising, displaying and holding merchandise. Additional vertical support bars, such as stanchions, may be used for further support. Alternatively, a point of sale display may be connected to and support one end of a member, while the other end of the member is connected to and supported by a wall, ceiling or floor. The wall, ceiling or floor may also display an image, for example, at or near the point of the member connection.

A point of sale display (or wall, ceiling or floor) preferably displays a larger-than-life size static image of a fashion model or models, typically wearing or otherwise displaying the merchandise available for purchase on the member connected thereto. Alternatively, comparable moving images can be displayed or projected onto the point of sale display (or wall, ceiling or floor). These larger-than-life size or moving images draw the consumer's attention to the point of sale display and thus to the associated merchandise.

Further characteristics and advantages of the present invention will become apparent from the following detailed description of preferred but not exclusive embodiments of the point of sale displays illustrated only by way of the following non-limiting examples.

BRIEF DESCRIPTION OF THE DRAWINGS

FIG. 9A shows a configuration using surface-mounted brackets, whereas FIG. 9B shows a configuration using flush-mounted brackets.

FIG. 10A shows a configuration using surface-mounted brackets, whereas FIG. 10B shows a configuration using flush-mounted brackets.

FIGS. 11A and 11C depict a short hanger bar protruding through or attached to the front point of sale display, whereas FIG. 11B lacks this feature. FIG. 11C also depicts a display aperture through the front point of sale display.

FIGS. 16B and 17B depict a display aperture in one of the point of sale displays, while FIGS. 16A and 17A do not.

DETAILED DESCRIPTION OF THE PREFERRED EMBODIMENTS

One preferred embodiment is a point of sale display (100) that may be mounted overhead, for example, hung from a ceiling as shown in FIGS. 1A-1E and 2. The point of sale display (100) may be made of materials such as wood, corrugated cardboard, plastic, metal, plexiglass, composite materials and the like. As used herein, wood may be engineered wood such as plywood or particle board as well as other varieties of natural hard and soft woods. The point of sale display may be a combination of two or more materials. Preferably, the point of sale display (100) is wood. A fastener (105) may be attached to a top end of the point of sale display. The fastener (105) may be a hook, a loop and the like such that a rope, wire or chain of sufficient load bearing strength may be connected to and hang the point of sale display from a ceiling or some other overhead structure. Alternatively, the point of sale display (100) may be hung or attached to a wall rather than to an overhead structure. Preferably, the point of sale display is hung so that its bottom edge is positioned several feet above the floor. For example, the bottom edge of the point of sale display may be about 1 foot to about 5 feet above the floor, preferably from about 3 feet to about 5 feet above the floor. It is preferable that the bottom edge of the point of sale display be sufficiently above the floor such that the merchandise, especially apparel, which is hung from the apertures in the point of sale display, does not contact the floor.

Figure 1B:
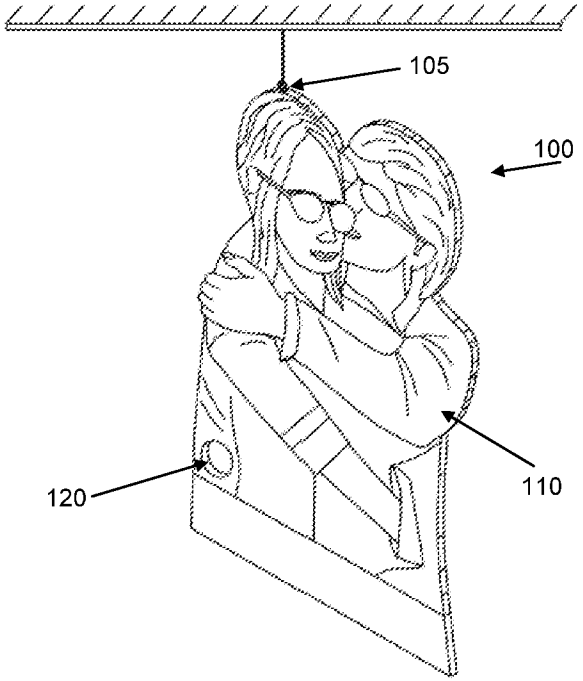
FIG. 1B: Isometric view of a point of sale display mounted overhead comprising a display aperture.
Figure 1A:
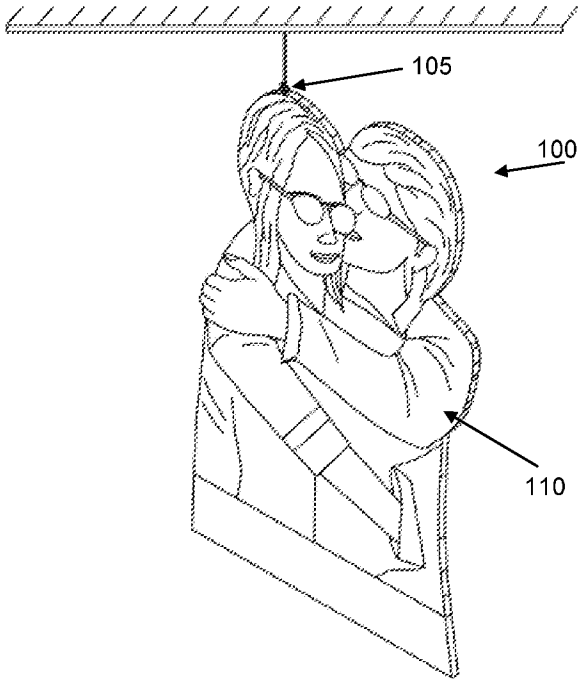
FIG. 1A: Isometric view of a point of sale display mounted overhead, such as a ceiling.
Figure 1D:
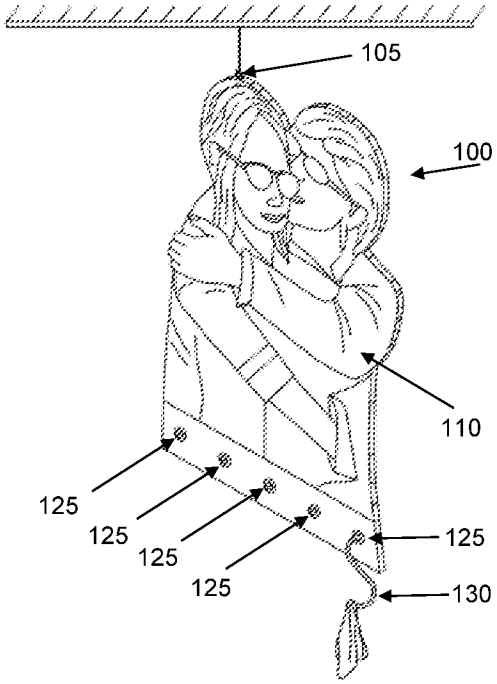
FIG. 1D: Isometric view of a point of sale display mounted overhead comprising hook apertures.
Figure 1C:
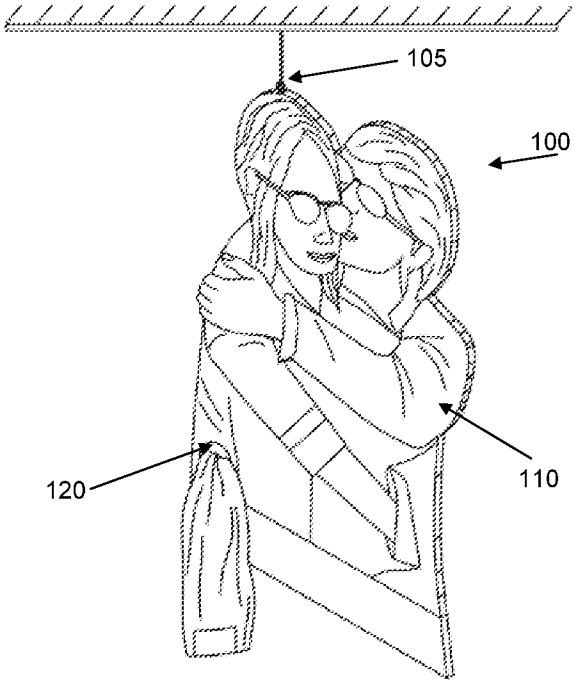
FIG. 1C: Isometric view of a point of sale display mounted overhead comprising a display aperture.
Figure 1E:
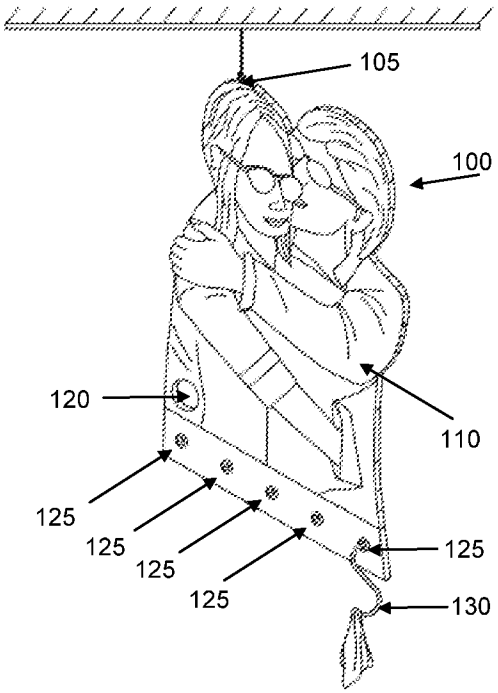
FIG. 1E: Isometric view of a point of sale display mounted overhead comprising both display and hook apertures.
Figure 2:
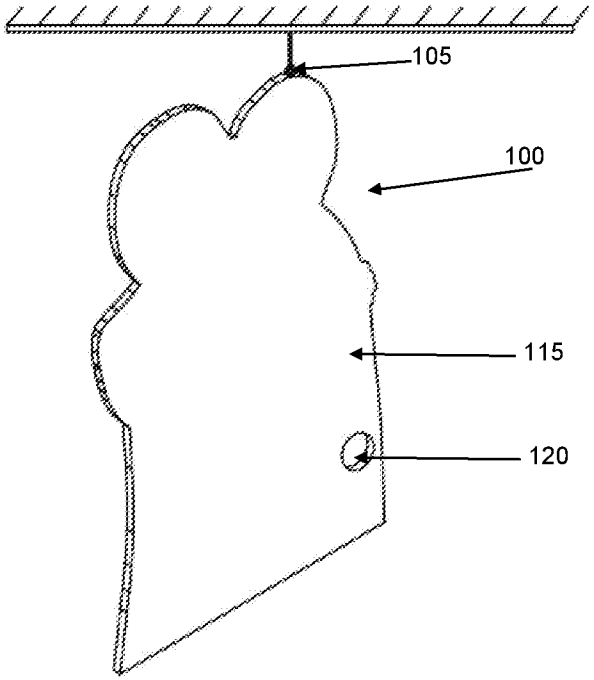
FIG. 2: A back view of a point of sale display mounted overhead.
Figure 3C:
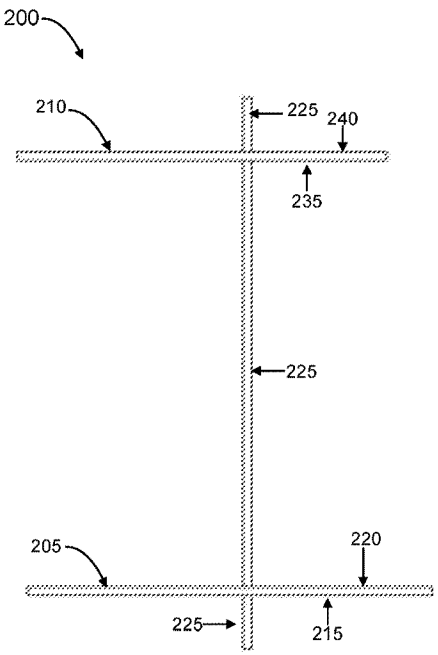
FIGS. 3A-3C: Top views of two substantially parallel point of sale displays connected by a hanger bar, whereby a short hanger bar protrudes through or is attached to both of the point of sale displays.
Figure 3B:
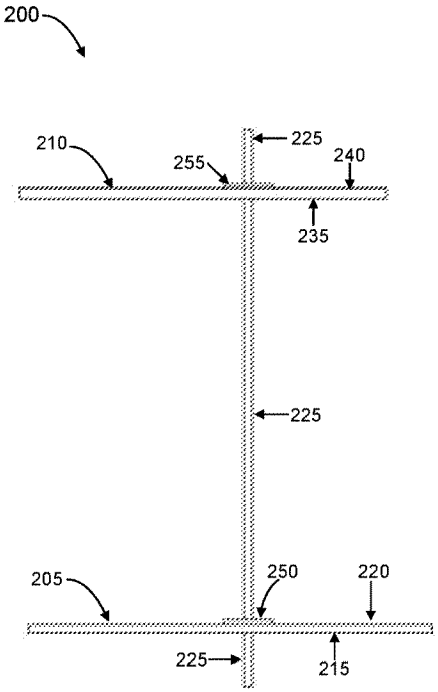
Figure 3A:
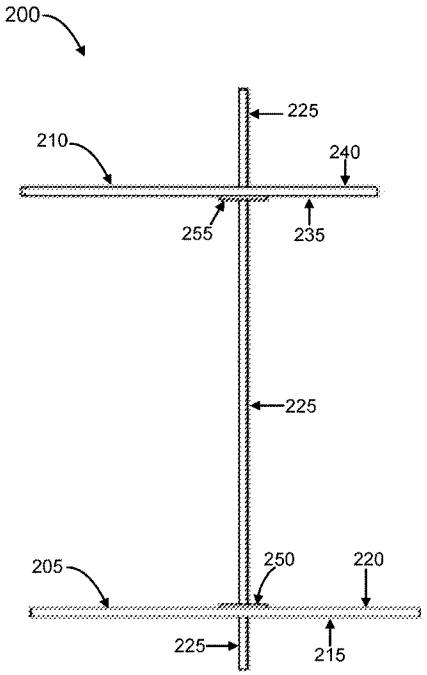

The point of sale display (100) has a first side and a second side. As shown in FIG. 1A-1E, preferably the first side of the point of sale display comprises an image display (110), and as shown in FIG. 2, the second side of the point of sale display comprises a backing (115). Alternatively, both sides could have an image display (110). The image display, as described further described herein, may be used in any of the embodiments of the invention. Also, as described in more detail below, an image display may be displayed on a wall, ceiling or floor to which a point of sale display is connected or otherwise attached.

The image display (110) is a still image, a moving image, or combination of still and moving images. For example, the image display is a still image showing one or more humans (e.g., fashion models), animals, cartoons or cartoon characters, landscapes, products, animations, and/or other drawings or sketches. The still image may show instead or additionally the clothing, garments, apparel, accessories or other merchandise that is available for purchase and associated with the point of sale display (for example, clothing hanging from an aperture or from a hanger bar, or laid upon shelving). Alternatively, the image display may be printed directly on to the point of sale display through silk screening or other conventional printing methods, or may be printed on paper, canvas, plastic, fabric, bamboo, sheet metal or other material which in turn is affixed to the point of sale display by glue, tape, staples, magnets, and the like.

Alternatively, the image display (110) are screens, monitors, and/or other electronics such as tablets, which present a moving image, such as a video or a rotating/changing slideshow comprising one or more still images, slides or photos. Like the still image of the preceding paragraph, the moving image may depict humans, animals, cartoons or cartoon characters, landscapes, products, animations, drawings, sketches and/or merchandise. The screens, monitors and/or other electronics may be connected to the Internet, or to another network such as a wide area network or a local-area network, to permit the consumer or store employee to access the marketer's website or sales system to purchase the merchandise.

A projector may be used to project a still image, moving image or combination of still and moving images, onto the image display (110), or onto the wall, ceiling or floor to which a point of sale display is connected or otherwise attached.

The point of sale display (100) may include speakers or other audio devices to permit an audio-visual presentation.

Figure 20:
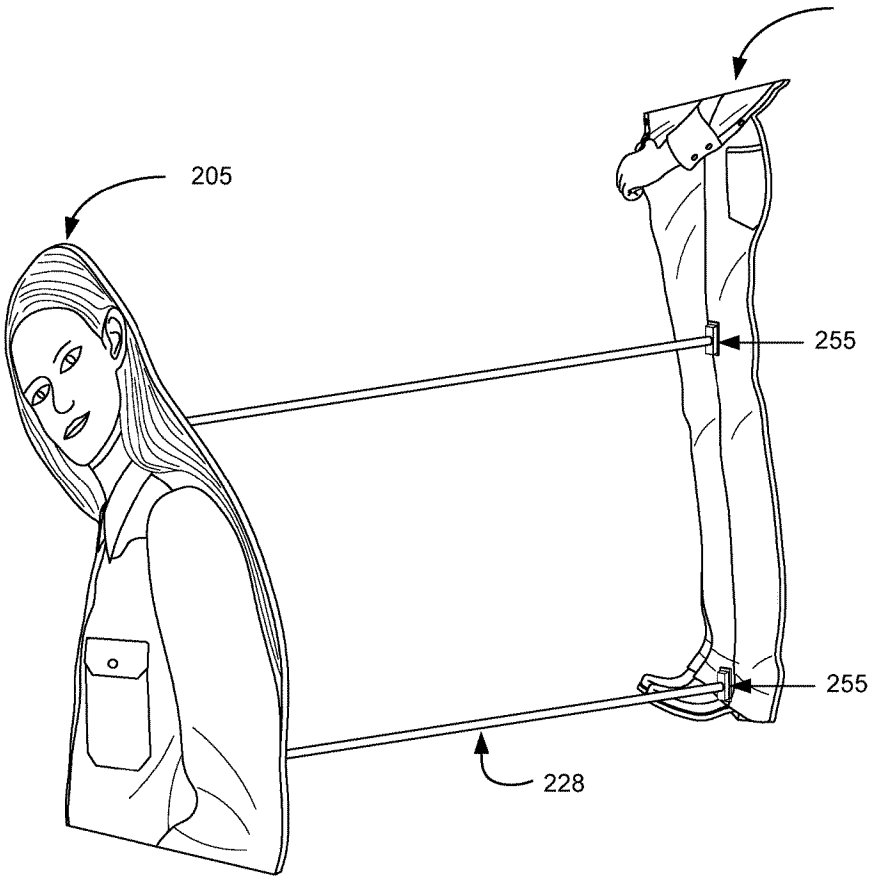
FIG. 20: An isometric view of two substantially parallel point of sale displays connected to each other by two parallel, straight hanger bars.

The shape of the point of sale display (100) resembles the shape of the subject used in the image display (110). For example, if the image display depicts a person standing (or a portion thereof), the point of sale display may resemble the outline of the standing person (or a portion thereof). As shown in FIGS. 1 and 2, the image display (110) depicts a portion of two humans. Accordingly, the point of sale display (100) of FIGS. 1 and 2 resembles the outline of the image depicted in the image display which, in accordance with this example, is a portion of two humans. As shown in FIG. 20 one image display may depict a portion of a human body and the other image display may depict the remaining portion of the human body.

The image display (110) is preferably printed on canvas or other material, and then cut-out based on the outline of the subject depicted in the image. The canvas is next placed over material used to make the point of sale display (100), such as plywood, and the plywood is cut to match the outline of the subject depicted in the image. The image display (110) is then applied to the cut-out plywood in matching fashion. Accordingly, the shape of the point of sale display (100) is typically dependent on the shape of the subject, and will vary as the subject varies. The point of sale display (100) may be asymmetric or symmetric.

As shown in FIG. 2, the second side of the point of sale display is typically a backing (115). The backing, as described herein, may be used in any of the embodiments of the invention.

In particular, the backing (115) may be any material that can be applied to the point of sale display. Preferably, if the backing is cut-out and applied to the point of sale display, it is cut to a shape that matches the outline of the point of sale display as discussed above. The backing may be printed on the point of sale display, for example, by silk screening or other conventional printing methods. Alternatively, the backing may be affixed to the point of sale display by glue, tape, staples, tacks, and the like. The backing may be reflective. For example, a reflective backing may a metallic foil, metalized film (such as metalized biaxially-oriented polyethylene terephthalate sold under brand names such as Mylar®), mirror, sheet metal or a combination thereof. The reflective backing may be tinted with a pigment. The reflective backing may be solid or may be patterned. Alternatively, the backing is non-reflective, for example, made of felt, canvas, paper, wallpaper, fabric, and natural materials such as bamboo, or combinations thereof. The non-reflective backing may also be paint applied directly to the second side of the point of sale display. The non-reflective backing may be solid or may be patterned. The backing material may also be applied along the width of the point of sale display.

According to this embodiment, the point of sale display (100) may be about 4 feet to about 20 feet in height, preferably between about 4 feet to about 18 feet in height, and even more preferably between about 4 feet and about 16 feet in height. Additionally, the point of sale display (100) may be about 1 feet to about 8 feet wide, preferably about 2 feet to about 8 feet wide, and even more preferably about 2 feet to about 6 feet wide. The height and width of the point of sale display (100) varies depending on the outline of the image depicted in the image display (110). The image may be life-sized, but is preferably larger than life-sized (i.e., oversized), accomplished for example, by magnifying a life-sized image.

The thickness of the point of sale display (100) may range from about ¼ inch thick to approximately 4 inches thick, preferably from about ¼ inches thick to about 3 inches thick, and even more preferably from about ½ inches thick to about 2½ inches thick.

As shown in FIGS. 1B-1E, apertures (120, 125) may be routed into the point of sale display. The apertures extend from the first side of the point of sale display through the second side of the point of sale display. The apertures may be round, square, triangular or irregularly shaped, and may vary in size. The backing may be used to cover the exposed portions of the apertures, along the width of the point of sale display.

One type of aperture is a display aperture (120). A display aperture, as described herein, may be used in any of the embodiments of the invention. A display aperture (120) comprises an opening of about 1 inch to about 10 inches, preferably about 2 inches to about 8 inches, and even more preferably about 3 inches to about 6 inches. For example, as shown in FIG. 1C, a display aperture (120) may be used to display merchandise, such that garments, clothing, apparel and/or other merchandise are placed though the display aperture (120). The size and number of display apertures may vary. For example, there may be between 1 and 10 display apertures (120), preferably between 1 and 8 display apertures (120), and even more preferably between 1 and 6 display apertures (120).

Another type of aperture is a hook aperture (125). The hook apertures (125) may have a grommet. A hook aperture, as described herein, may be used in any of the embodiments of the invention. A hook aperture (125) comprises an opening of about ¼ inch to about 2 inches as shown in FIGS. 1D and 1E. For example, a hook aperture (125) may be used to insert a hook (130) or other hanging device in order to display merchandise. Preferably, the hook (130) is S-shaped. The number and size of hook apertures (125) can vary. For example, there may be between 1 and 20 hook apertures (125), preferably between 2 and 18 hook apertures (125), and even more preferably between 4 and 16 hook apertures (125).

A point of sale display (100) may have either a display aperture (120) or a hook aperture (125) or both. Preferably, these apertures are positioned at a sufficient height on the point of sale display (100) so the merchandise hung therefrom (directly or off of hooks inserted through the hook apertures) does not contact the floor.

Another preferred embodiment is a system of one or more point of sale displays (200) used as vertical structural supports for one or more members connected thereto. A member may be, but is not limited to, a hanger bar, a rod, a beam, a garment rack, shelving or combinations thereof.

Figure 19:
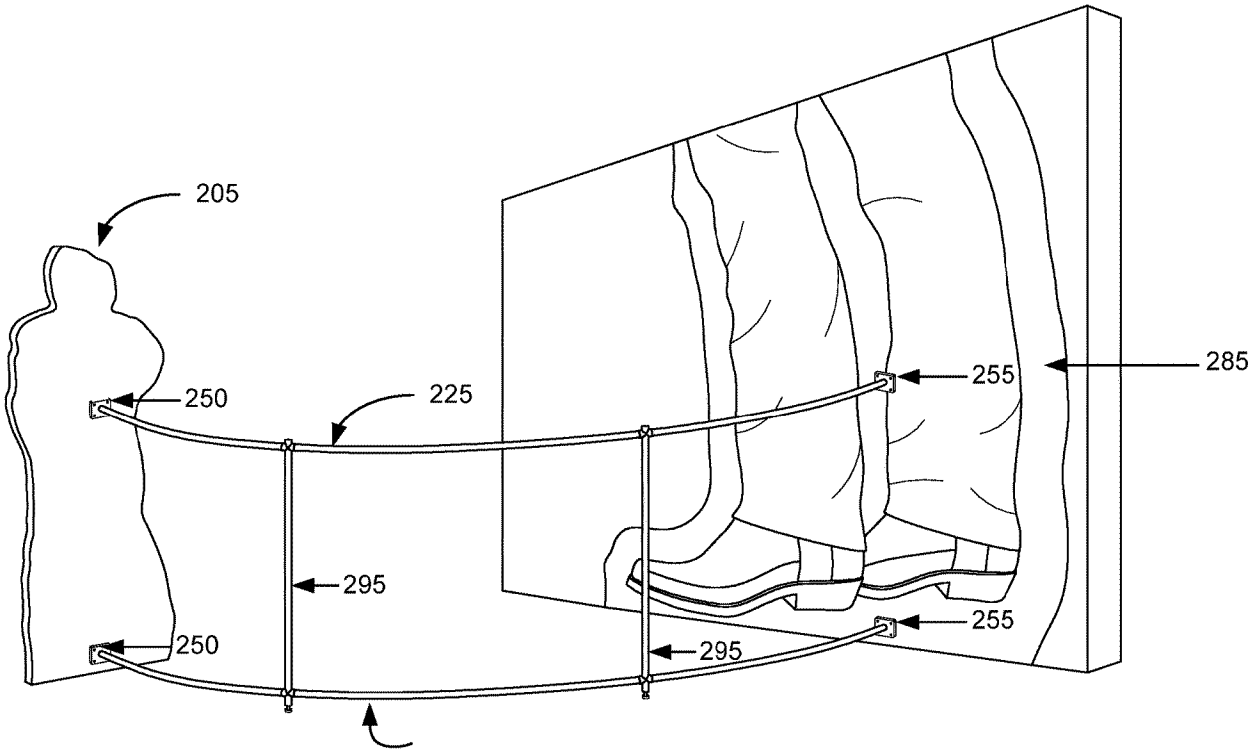
FIG. 19: An isometric view of a single point of sale display connected to a wall by two parallel, curved hanger bars, whereby the hanger bars utilize a couple of vertical poles for additional support. Here, an image is depicted on the wall.
Figure 21:
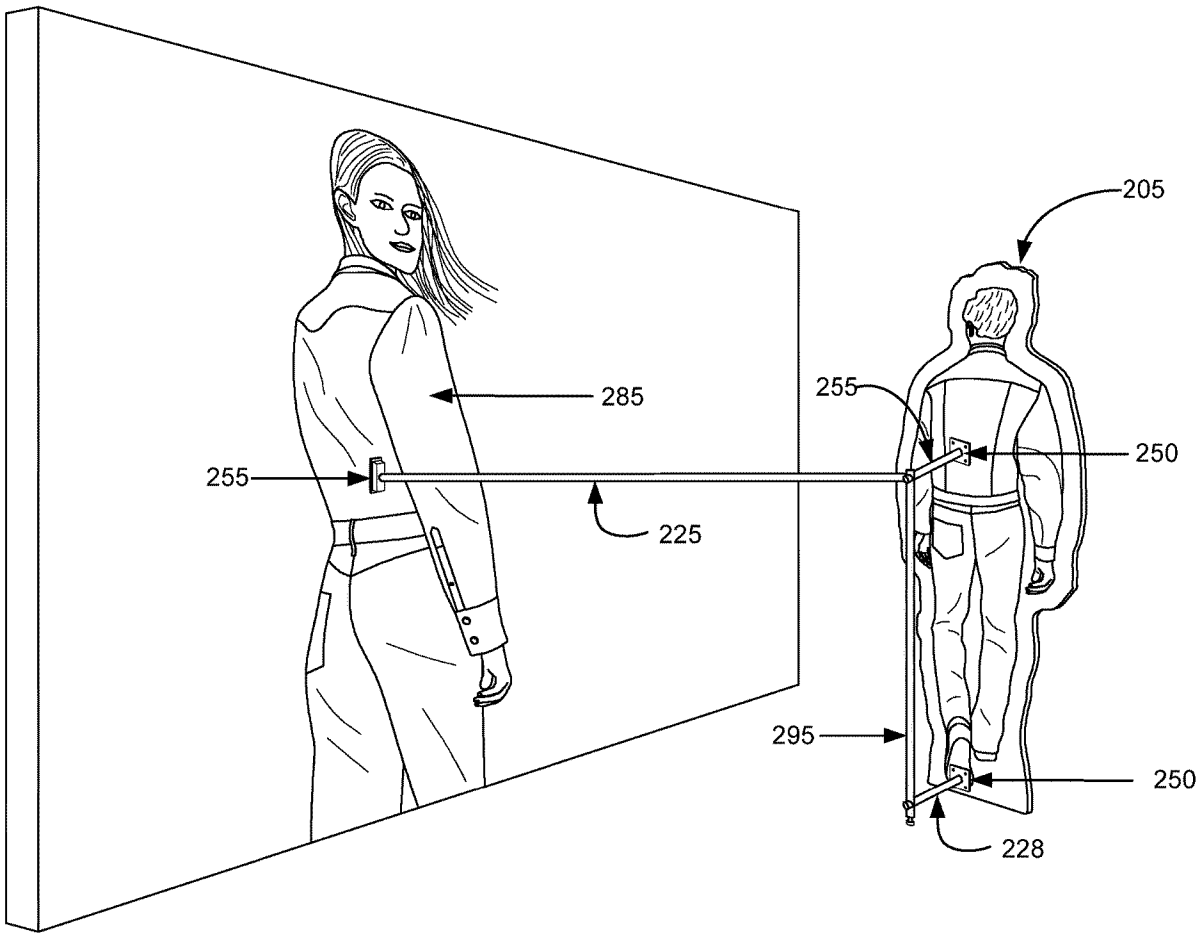
FIG. 21: An isometric view of a point of sale display substantially perpendicular to a wall, whereby the point of sale display and the wall are connected to each other by the depicted configuration of straight hanger bars. A vertical pole provides additional support. Here, an image is depicted on the wall.

The system may use a single point of sale display. For example, a point of sale display may be connected to a surface (typically a wall, but it could be a ceiling, floor or other surface) by one or more hanger bars or other members. For example, as shown in FIGS. 19 and 21, a point of sale display (205) is connected to a wall by one or more curved or S-shaped or straight hanger bars (225). Multiple, spaced-apart hanger bars (225, 265) may be used in a parallel configuration, and one or more vertical poles or stanchions (295) may be used to provide additional support.

An image (285) is adhered to or projected onto the wall or other surface. The image (285) may be a still image such as sticker, or an image printed on paper, canvas, plastic, fabric, bamboo, sheet metal or other material which in turn is adhered to the wall by glue, tape, staples, magnets, and the like. In addition, the image (285) may be painted onto the surface and/or projected onto the wall or other surface. The image may be a moving image, or a combination of still and moving images, projected onto the wall or other surface, or displayed by various electronics as described above.

Figure 12B:
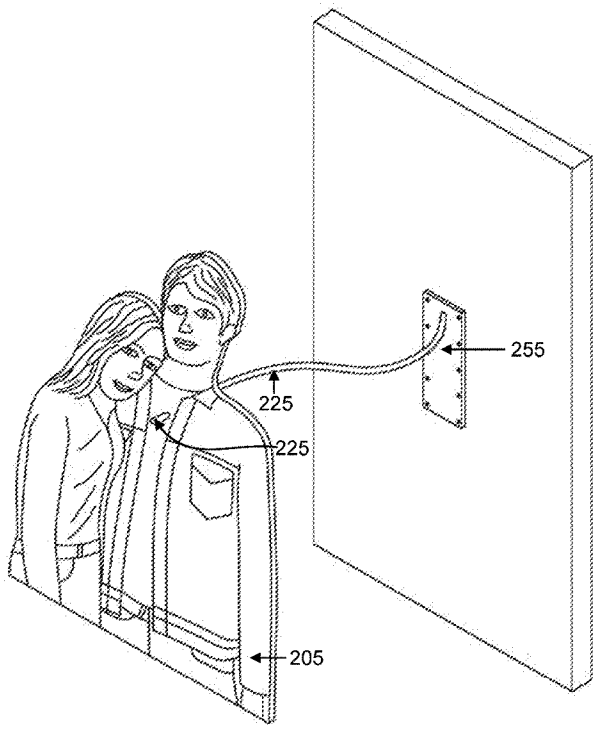
FIGS. 12A-12B: Respectively, isometric front-facing views of a point of sale display connected to a wall (the large rectangular surface) by a curved or an S-shaped hanger bar. The hangar bar may be connected to the wall by a bracket as shown, or otherwise.
Figure 12A:
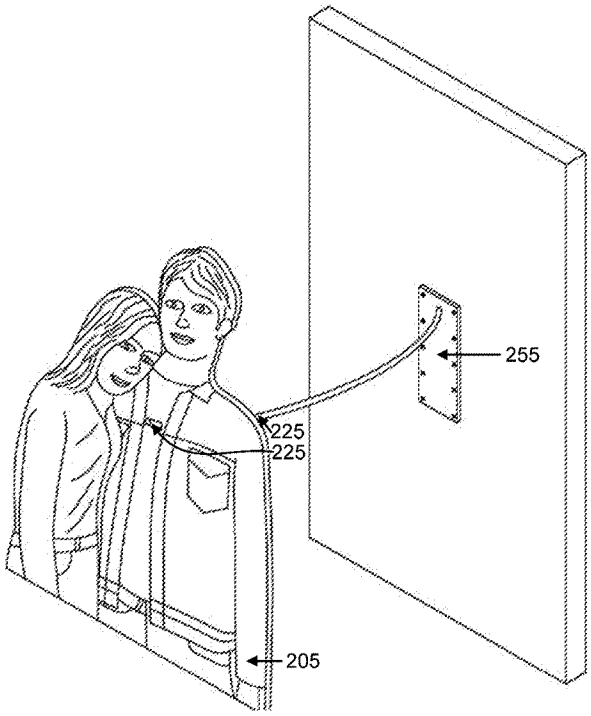
Figure 13:
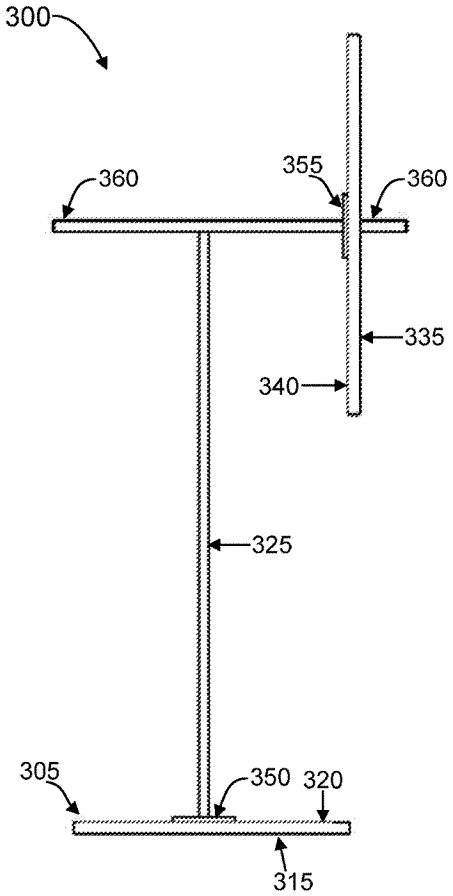
FIG. 13: A top view of two substantially perpendicular point of sale displays connected by multiple hanger bars, wherein a short hanger bar protrudes through or is connected to one of the point of sale displays.

Another example is shown in FIGS. 12A and 12B, whereby a point of sale display (205) is connected to and supports one end of a member (225), while the other end of the member is connected to and supported via a bracket (255) surface- or flush-mounted to the wall. In this example, the wall lacks an image.

The system may use two or more point of sale displays. Continuing the example of the preceding paragraph, a first point of sale display may be mounted to the surface, and is connected to a second point of sale display by one or more hanger bars or other members (not shown).

Figure 23:
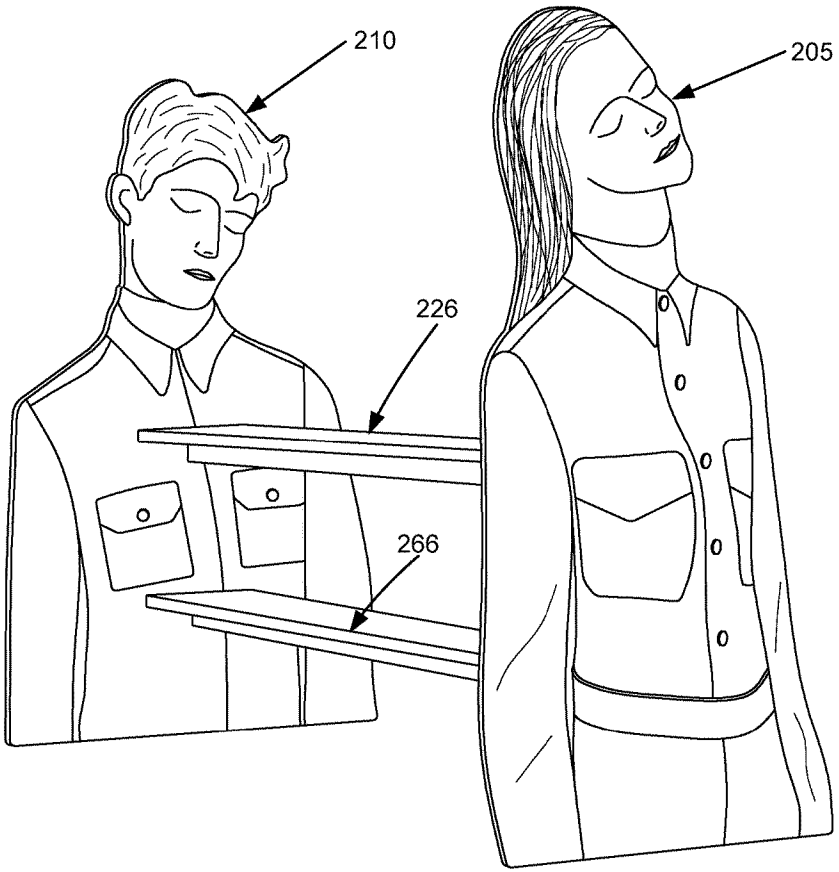
FIG. 23: An isometric view of two substantially parallel point of sale displays connected to each other by two parallel shelves 226 and 266.

More preferably, as shown in FIGS. 3-11, a first point of sale display (205) and a second point of sale display (210) are connected by and support at least one member, for example, a hanger bar (225), wherein the point of sale displays are spaced apart from each other (preferably by several feet) and are substantially parallel to each other. Each of the point of sale displays (205, 210) may be connected to and support at least one member, preferably a hanger bar (225) or multiple hanger bars (225, 265), via a bracket (250, 255) or another connecting device affixed to the point of sale display. As shown in FIG. 23, members may be shelves (226, 266).

As described above, the point of sale displays (205, 210) are preferably made of wood, including but not limited to engineered wood such as plywood or particle board as well as other varieties of natural hard and soft woods. However, other materials may be used in place of or in combination with wood, such as corrugated cardboard, plastic, metal, plexiglass, composites and the like. One side of the point of sale display preferable has an image display (215, 235) (e.g., a still and/or moving image as described above) and the other side is preferably covered by a backing (220, 240) (e.g., a reflective or non-reflective backing as described above).

Each of the first point of sale display (205), the second point of sale display (210), and/or the image (285) are about 4 feet to about 20 feet in height, preferably about 5 feet to about 15 feet in height, even more preferably about 6 feet to about 14 feet in height, and yet even more preferably about 7 feet to about 12 feet in height. Point of sale displays (205, 210) and/or images (285) may have the same or different heights.

Additionally, each of the first point of sale display (205), the second point of sale display (210) and/or the image (285) may be about 1 feet to about 8 feet wide, preferably about 2 feet to about 8 feet wide, and even more preferably about 2 feet to about 6 feet wide. Point of sale displays (205, 210) and/or images (285) may have the same or different widths.

The height and width of each point of sale display (205, 210) varies depending on the image display positioned on the first side of the point of sale display, as previously described. The height and width of the point of sale display varies depending on the outline of the image depicted in the image display, as discussed above. Similarly, the height and width of the image (285) varies depending on what is depicted in the image and/or the size of the surface to which the image is adhered to. As described above, the image may be life-sized or larger than life-sized or magnified.

The thickness of each point of sale display (205, 210) may range from about ¼ inch thick to about 4 inches thick, preferably about ¾ inch to about 3½ inches thick, and even more preferably about 1 inch thick to about 3 inches thick. Point of sale displays may have the same or different thicknesses.

The hanger bar or bars (225, 265) are preferably metal, but may be any other material, including but not limited to wood, plastic, vinyl or a composite material, so long as the material can sufficiently support the expected load, for example, the merchandise hanging from the hanger bar. Similarly, other members such as shelves, rods beams and the like may be made of metal, wood, plastic, vinyl or a composition material. A metal hanger bar is preferably made of steel, iron, aluminum, or chrome, and a vinyl hanger bar is preferably polyvinyl chloride or PVC. The hanger bars (225, 265) and/or brackets (250, 255) may also use one or more joints which allow the hanger bar(s) to pivot, for example as shown in FIG. 21. The hanger bar(s) may be solid or hollow. The length of the hanger bar(s) is about 20 inches to about 100 inches, but could be longer or shorter. The length is preferably between about 48 inches to about 84 inches. Hanger bar are preferably straight (e.g., FIGS. 3-10, 13-18 and 20), curved (e.g., FIGS. 12A and 19) or S-shaped (e.g., FIG. 12B and FIG. 22), but could be of any practical shape. Also, differently-shaped bars may extend from the same general wall or point of sale location. For example, a curved or S-shaped hanger bar may extend to the left of location, a straight hanger bar may extend straight out from the location, and another curved or S-shaped hanger bar may extend to the right of the location, the ends of these bars being connected to respective point of sale displays. The hanger bar(s) may be connected to vertical poles or stanchions for additional support.

Figure 10B:
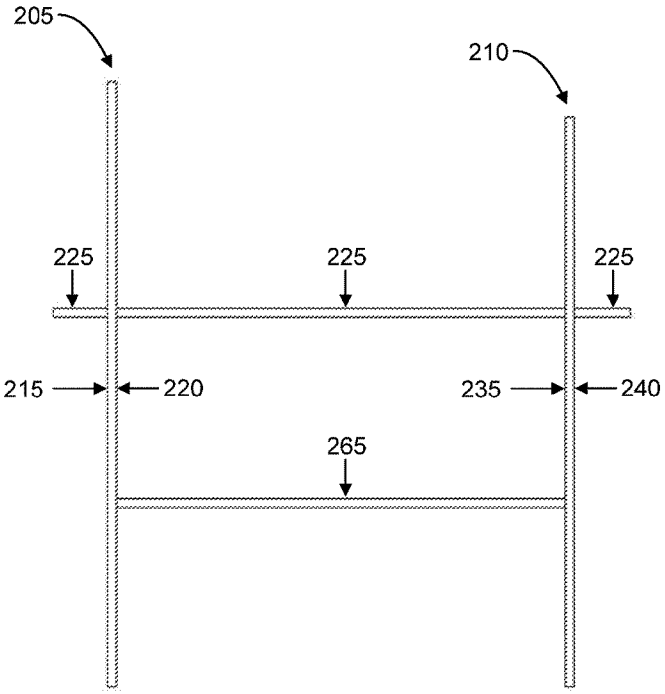
FIGS. 10A-10B: Side views of two substantially parallel point of sale displays connected by two hanger bars.
Figure 10A:
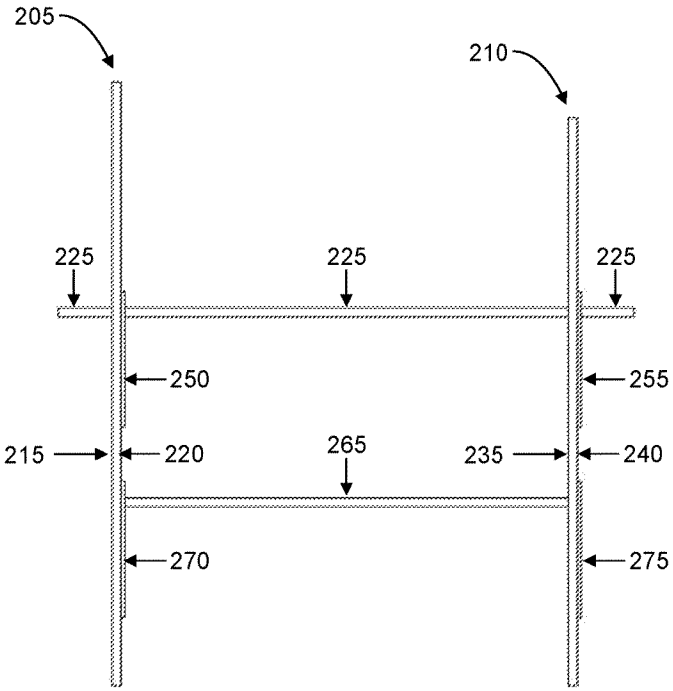

In the systems shown in FIG. 3-8, each point of sale display (205, 210) structurally supports one or more members. In some systems, there may be additional members, for example an additional hanger bar (265) as shown in FIGS. 10A-10B, or an additional vertical support bar. In the system shown in FIGS. 9A-9B, a two dimensional, five-sided support member (260) is attached to a side of a point of sale display, to provide further support.

Figure 11C:
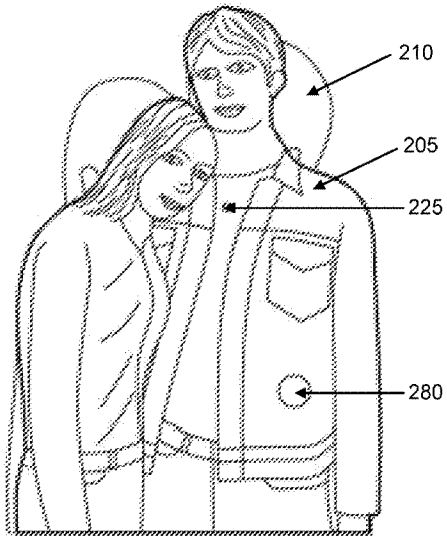
FIGS. 11A-11C: Front views of two substantially parallel point of sale displays.
Figure 11B:
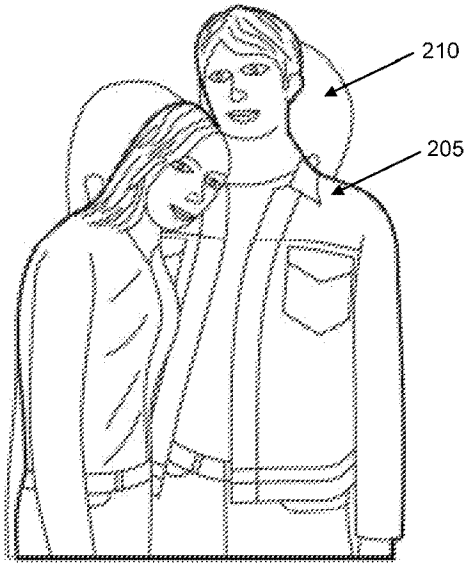
Figure 11A:
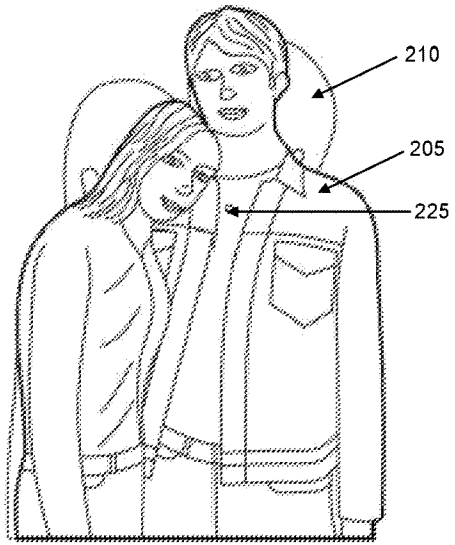

The point of sale display may have one or more display apertures and/or hook apertures as previously described. One or more of the point of sale displays may have only display aperture(s), only hook aperture(s) or a combination of both display and hook apertures. For example, FIG. 11C shows a point of sale display (205) which has a display aperture (280). Preferably, these apertures are positioned sufficiently high on the point of sale display, so the merchandise hung therefrom (directly or off of hooks inserted through the hook apertures) does not contact the floor.

Figure 18:
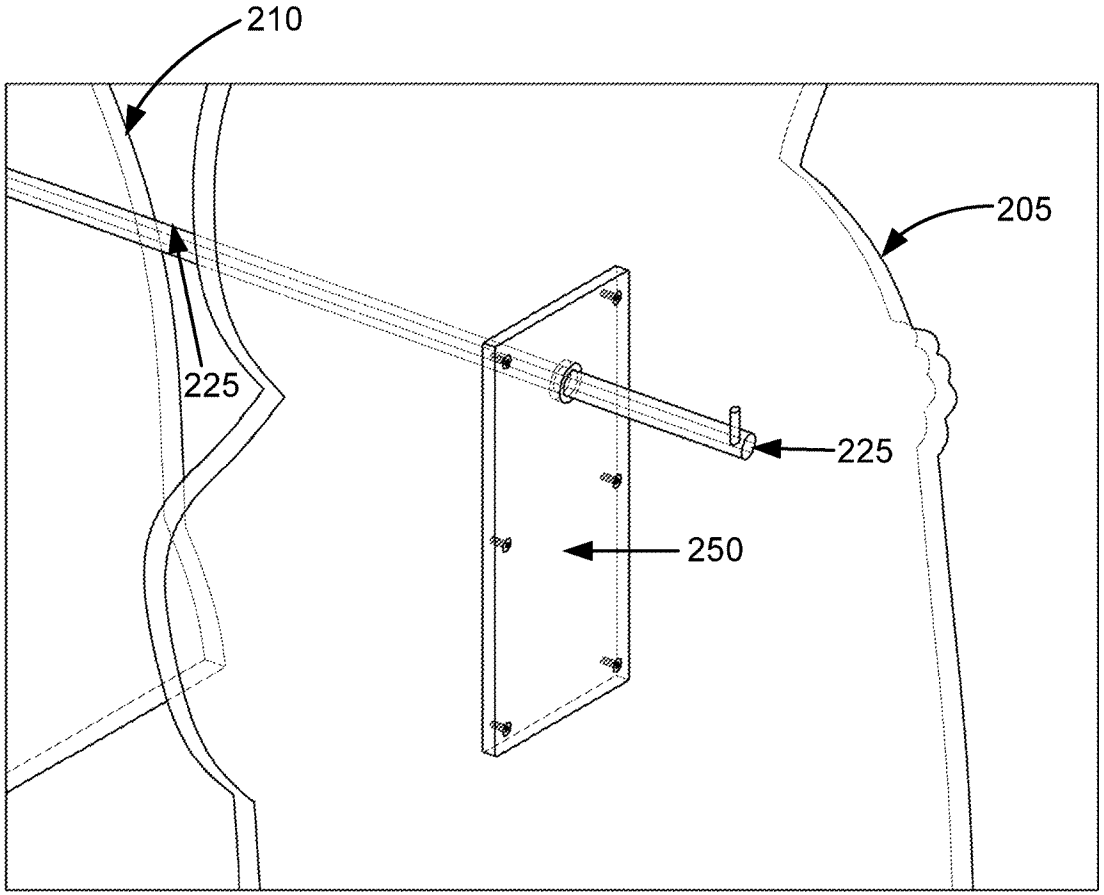
FIG. 18: A view of a flush-mounted bracket 250, whereby a short portion of hanger bar 225 protrudes though a hole or shaft collar in the bracket.

A short portion of a hanger bar or bars (225, 265) can protrude through a point of sale display, through a hole or a shaft collar in the bracket as shown in FIG. 18. Clothes or other merchandise can be hung from the short portion, typically a sample of what is being hung on the longer hanger bar, or complementary merchandise (e.g., a dress and matching purse).

Alternatively, a separate short hanger bar may be attached the front of the point of sale display and extend therefrom. This short hanger bar can be welded to the bracket, or if hollow, be fitted over a protrusion extending from the bracket.

Figure 4C:
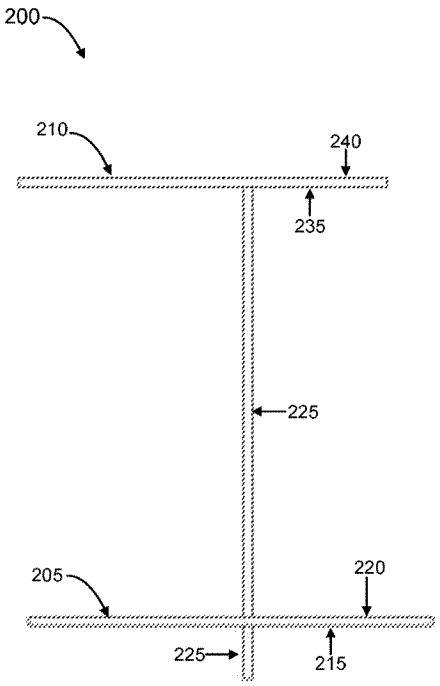
FIGS. 4A-4C: Top views of two substantially parallel point of sale displays connected by a hanger bar, whereby a short hanger bar protrudes through or is attached to only one of the point of sale displays.
Figure 4B:
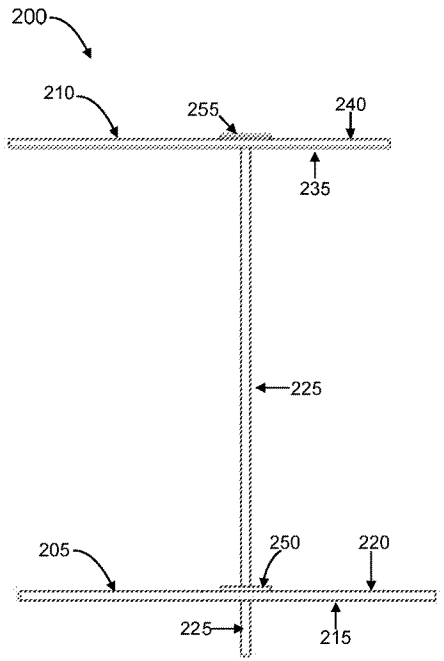
Figure 4A:
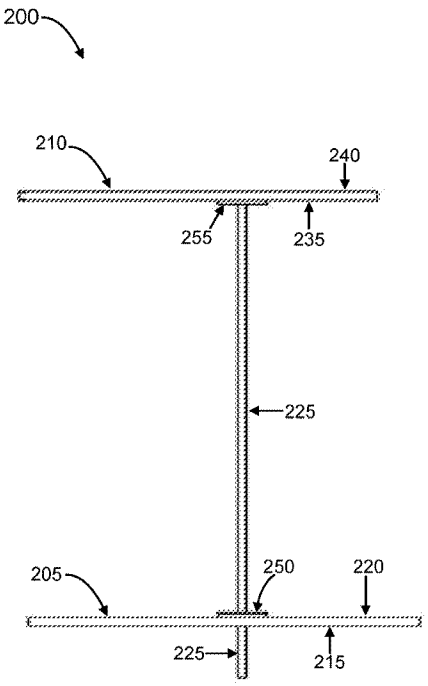
Figure 5C:
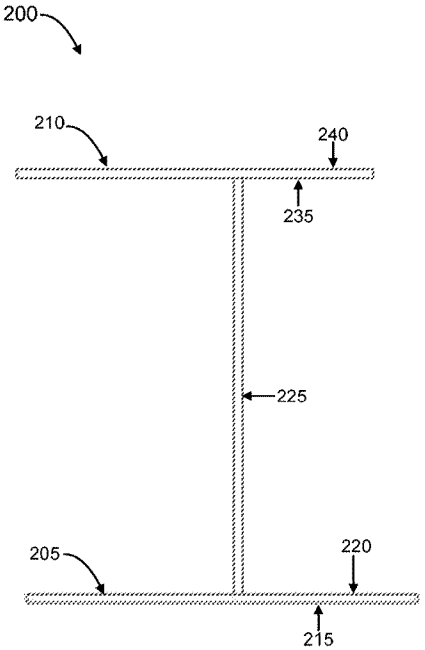
FIGS. 5A-5C: Top views of two substantially parallel point of sale displays connected by a hanger bar, whereby a short hanger bar neither protrudes through nor is attached to the point of sale displays. The brackets which connect the hanger bar to each point of sale display may be surface mounted, as shown in FIGS. 3A-5A and 3B-5B, or may be flush-mounted, as shown in FIGS. 3C-5C. Such brackets may be positioned on the first or second side of the point of sale display.
Figure 5B:
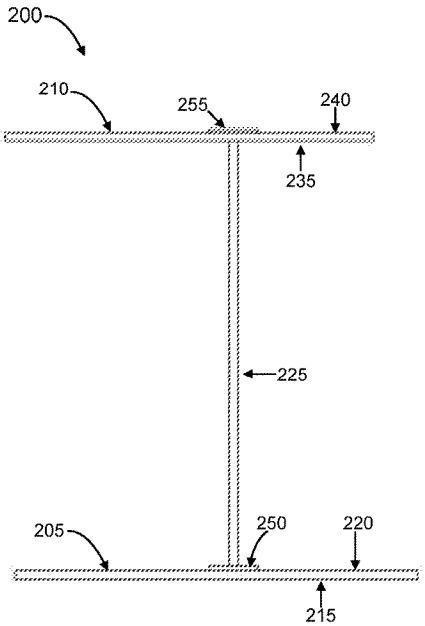
Figure 5A:
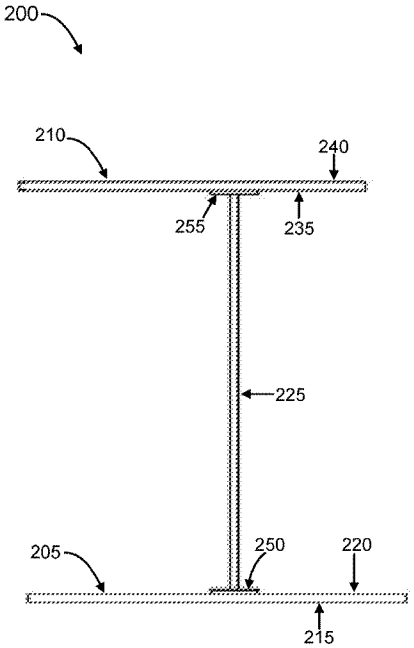

In the systems shown in FIGS. 4A-4C, the hanger bar (225) protrudes through one point of sale display (205). In the systems shown in FIGS. 3A-3C, the hanger bar (225) protrudes through both point of sale displays (205, 210). In the systems shown in FIGS. 5A-5C, the hanger bar (225) does not protrude through any point of sale display. The protruding/extending portion may be about 1 inch to about 15 inches in length, preferably about 2 to about 10 inches in length, and even more preferably about 3 to about 8 inches in length.

Figure 6:
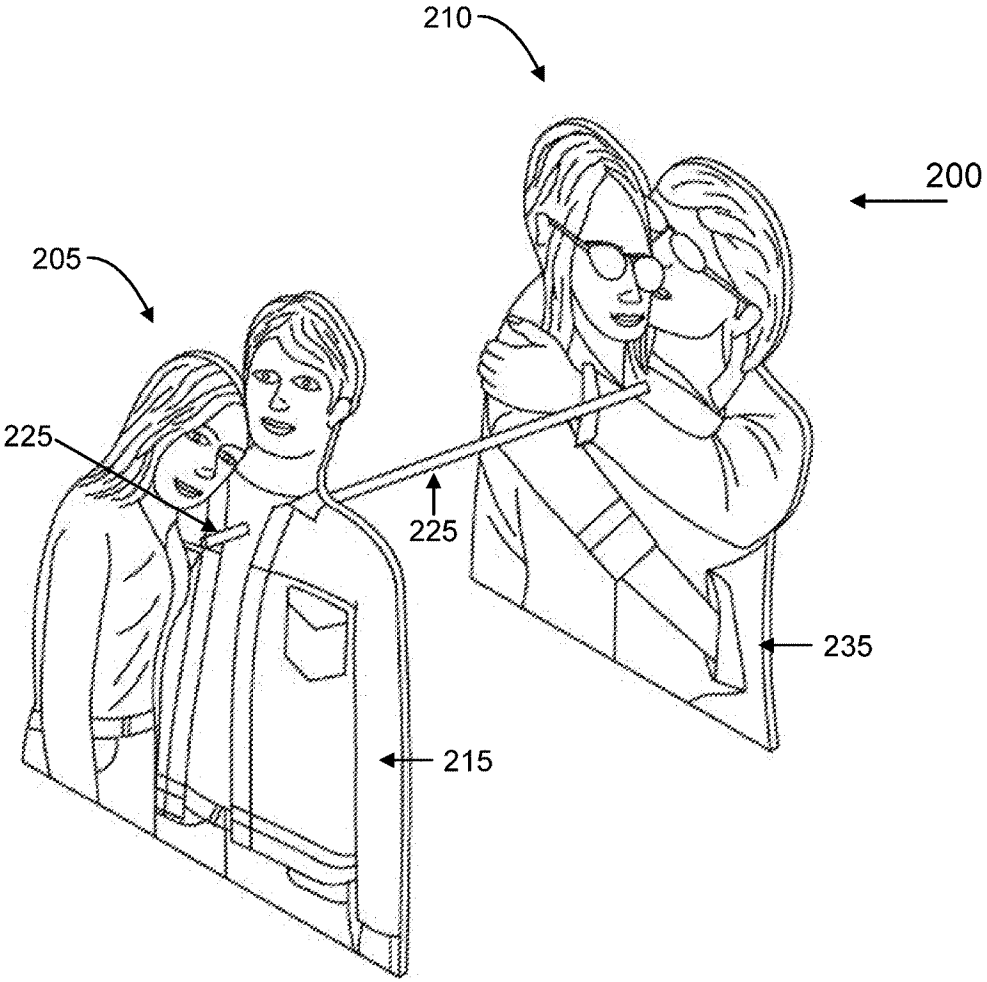
FIGS. 6, 7 and 8A: Respectively, an isometric front-facing view, an isometric back-facing view, and a side view of two substantially parallel displays connected by a hanger bar, whereby a short hanger bar protrudes through or is attached to one of the point of sale displays. In these three figures, the connecting bracket is surface mounted to the point of sale displays.
Figure 7:
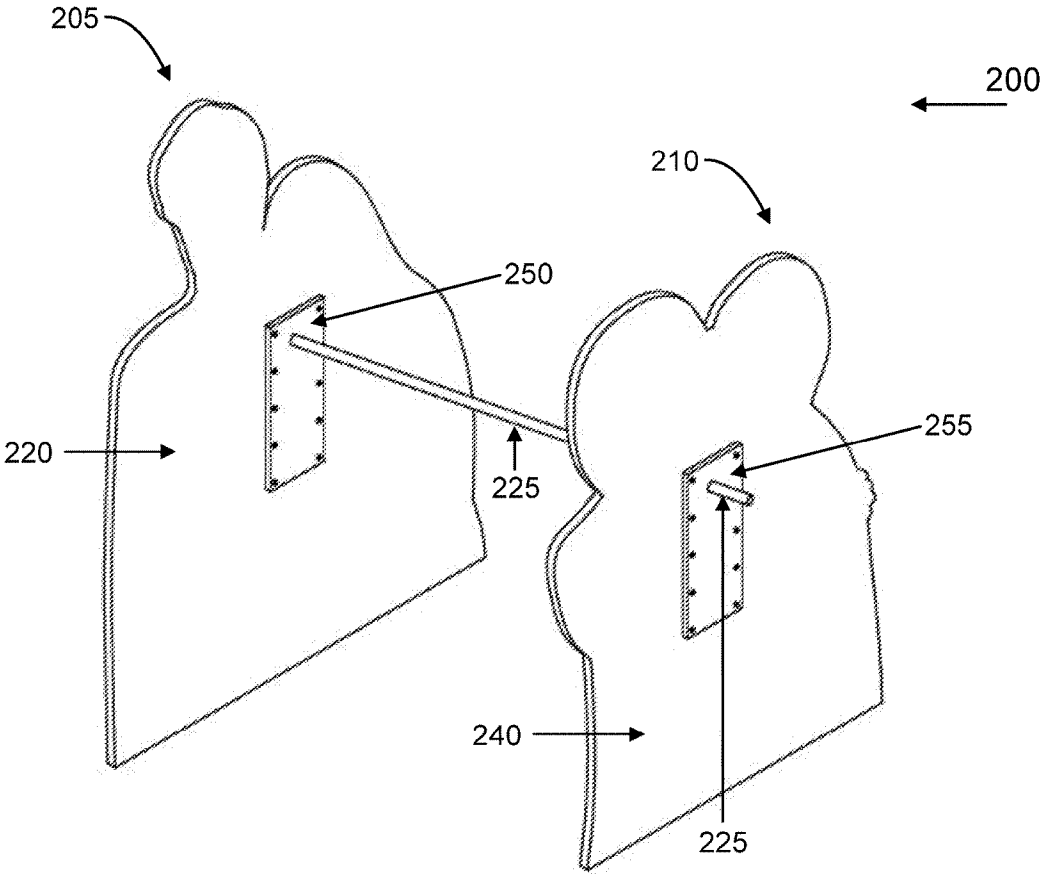
Figure 8B:
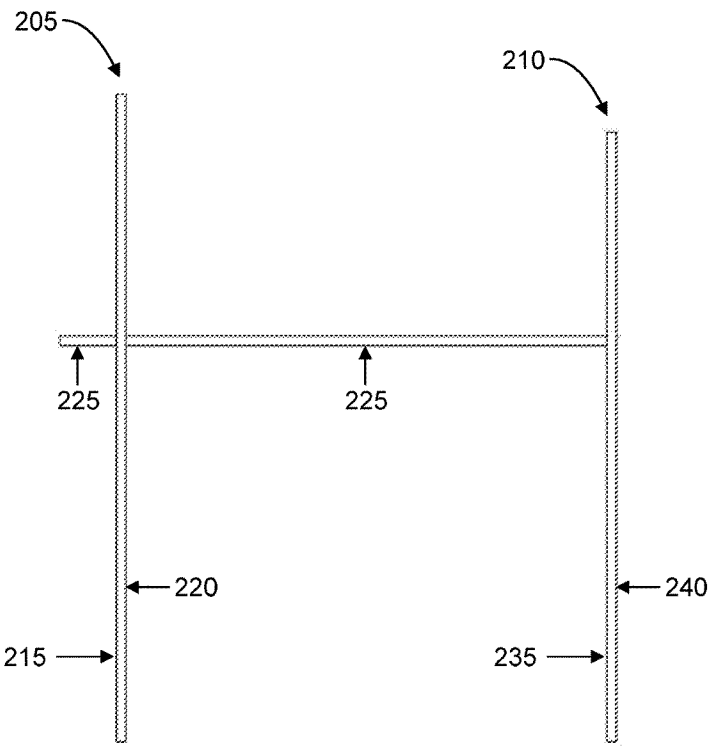
FIG. 8B: A side view of the configuration of FIGS. 6, 7 and 8A, whereby the connecting bracket is flush mounted, rather than surface mounted, to the point of sale displays.
Figure 8A:
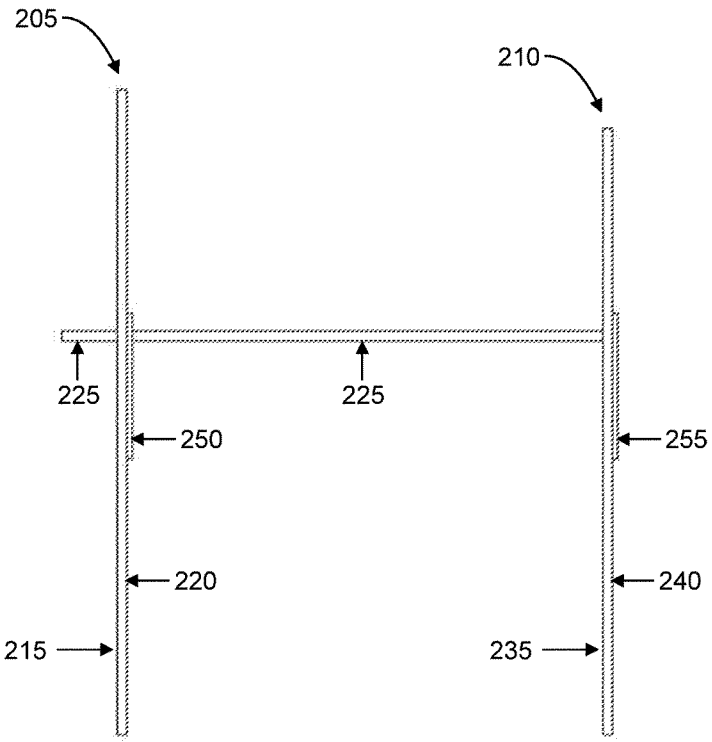
Figure 9B:
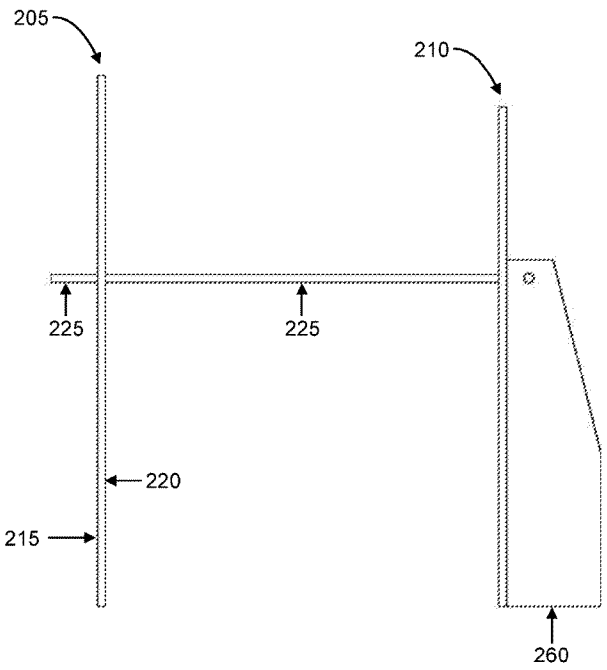
FIGS. 9A-9B: Side views of two substantially parallel point of sale displays connected by a hanger bar, wherein one of the point of sale displays is connected to a support member 260.
Figure 9A:
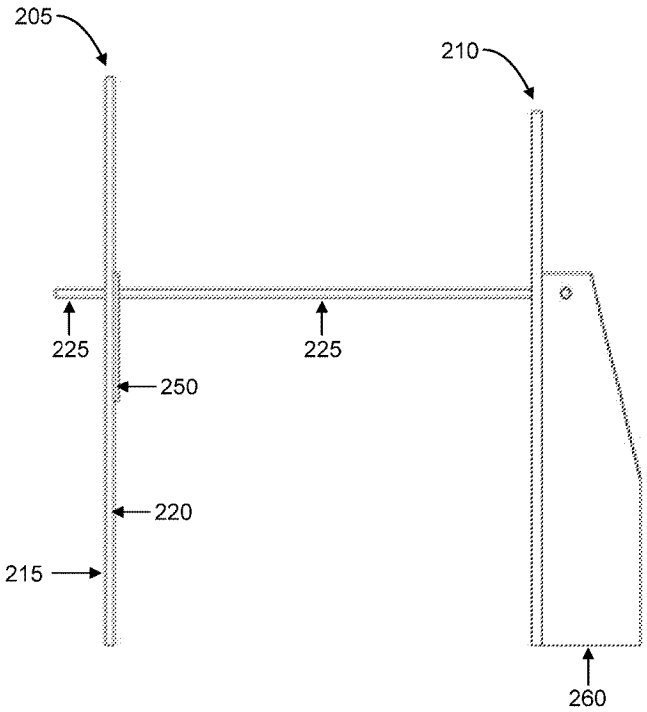

As shown in FIG. 6 and FIG. 7, the hanger bar (225) may be positioned at a height of about 30 inches to about 70 inches above the floor, preferably about 40 inches to about 65 inches above the floor, and even more preferably about 45 inches to about 62 inches above the floor. The hanger bar (225) is preferably sufficiently high off the floor so the merchandise hanging therefrom (either directly or from hangers) does not contact the floor.

Figure 22:
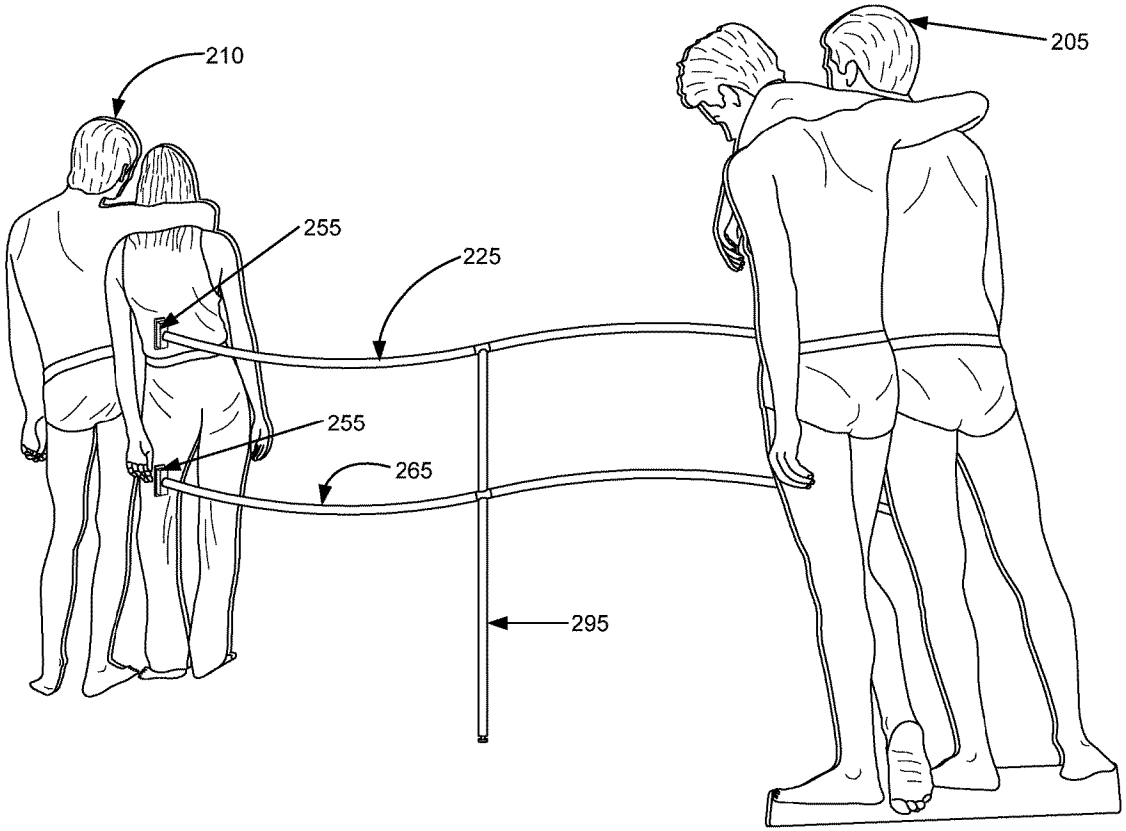
FIG. 22: An isometric view of two substantially parallel point of sale displays connected to each other by two parallel, S-shaped hanger bars, whereby a vertical pole provides additional support.

As shown in FIGS. 10A-10B and FIG. 22, two hanger bars (225, 265) may be connected to and support two point of sale displays (205, 210), wherein each hanger bar may be used to display and hang merchandise. A first hanger bar (225) is preferably positioned at a height of about 40 inches to about 70 inches above the floor and a second hanger bar (265) is positioned about 20 inches to about 40 inches above the ground. More preferably, a first hanger bar (225) is positioned at a height of about 45 inches to about 65 inches above the floor and a second hanger bar (265) is positioned at a height of about 30 inches to about 45 inches above the floor. Even more preferably, a first hanger bar (225) is positioned at a height of about 50 inches to about 62 inches above the floor and a second hanger bar (265) is positioned at a height of about 35 inches to 50 inches above the floor. It is also contemplated to have more than two hanger bars positioned between two point of sale displays. Alternatively, other members such as rods, beams, a garment rack or shelving (see FIG. 23), may be connected to and supported by and between the two point of sale displays.

A support bar (228) may be positioned between and couple to the two point of sale displays. Support bar (228) provides support and sturdiness, and is not intended to be used to hang merchandise. For example, as shown in FIGS. 19-21, a hanger bar (225) is positioned at a height of about 30 inches to about 70 inches above the floor and a support bar (228) is positioned at a height of about 1 inch to about 15 inches above the floor. More preferably, a hanger bar (225) is positioned at a height of about 40 inches to about 65 inches above the floor and a support bar (228) is positioned at a height of about 1 inch to about 15 inches above the floor. Even more preferably, a hanger bar (225) is positioned at a height of about 45 inches to about 62 inches above the floor and a support bar (228) is positioned at a height of about 1 inch to about 15 inches above the floor.

The hanger bar (225) preferably attaches to each point of sale display by a flush-mounted bracket (250, 255), whereby the bracket is positioned in a cavity that has been routed into the wood, for example FIGS. 3C, 4C and 5C and 18. For the flush-mounted brackets (see FIG. 18), the depth of the cavity matches the depth of the bracket, preferably about ¼ to 3/16 inch. Alternatively, the hanger bar (225) may be attached to the point of sale display by a surface-mounted bracket, for example FIGS. 3A, 3B, 4A, 4B, 5A, and 5B, or by a connecting device such as a hook, socket, hanger or pivot joint. The pivot joint (whether located on the point of sale display bracket or the wall or at the end of the bar) permits the hanger bar (225) and thus the point of sale located at the other end of the hanger bar to be positioned at different angles (see FIG. 21), so the connection between the hanger bar and the point of sale display or wall need not always be fixed at 90 degrees. The bracket or other connecting device may be attached to the point of sale display by conventional mechanical or chemical fasteners such as nails, screws, bolts, glue or the like. The bracket may include a shaft collar through which a hanger bar is inserted (FIG. 18). The bracket may instead have a protrusion over which a hollow member, such as a hollow hanger bar, may be positioned (that is, a male-female coupling). Preferably, the bracket is mounted on the side of the point of sale display which has the backing.

In yet another system (300), two or more point of sale displays (305, 310) are connected by and support one or more members such as hanger bars, whereby a first point of sale display is positioned substantially perpendicular to the second point of sale display. The first and second substantially perpendicular point of sale displays may be connected by and support a curved hanger bar (see FIG. 19), or may be connected by and support at least hanger bars that are connected substantially perpendicular to each other (see FIGS. 13-17). The hanger bars (or other members) are connected to the point of sale displays via brackets or other connecting devices, as described above.

In the example shown in FIGS. 13-17, a first bracket (350) is mounted in or on a first point of sale display (305). The first bracket (350) connected to one end of a first hanger bar (325). The other end of the first hanger bar (325) is connected to one end of a second hanger bar (360) such that the first and the second hanger bars are substantially perpendicular. The other end of the second hanger bar (360) is connected to a second bracket (355) mounted in or on the second point of sale display (310), and may further be connected to a vertical pole or stanchion (365) to provide additional support. The vertical pole or stanchion may instead be connected to a third hanger bar (370), which is substantially parallel to the second hanger bar (360) and is connected a third bracket (375) positioned in or on the second point of sale display (310).

Figure 14:
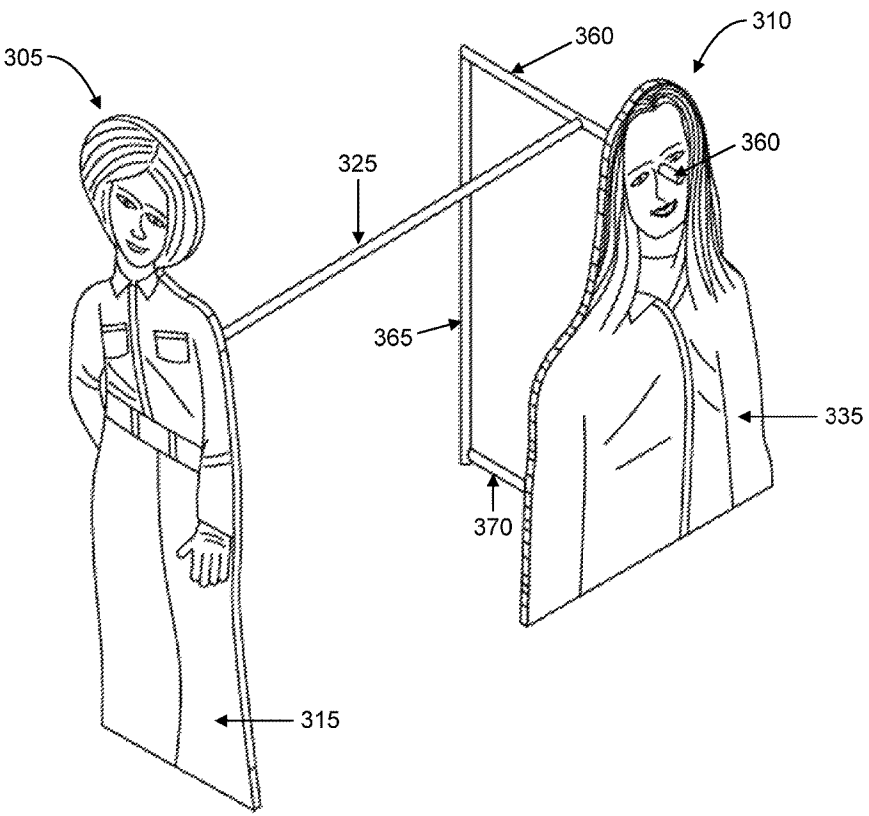
FIG. 14: An isometric view of the configuration of FIG. 13.
Figure 15:
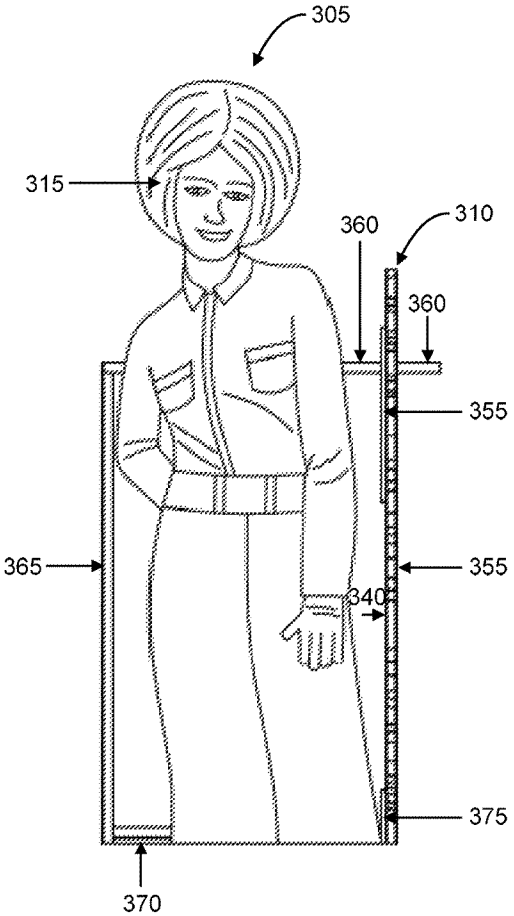
FIG. 15: A front view of the configuration of FIG. 13.
Figure 16B:
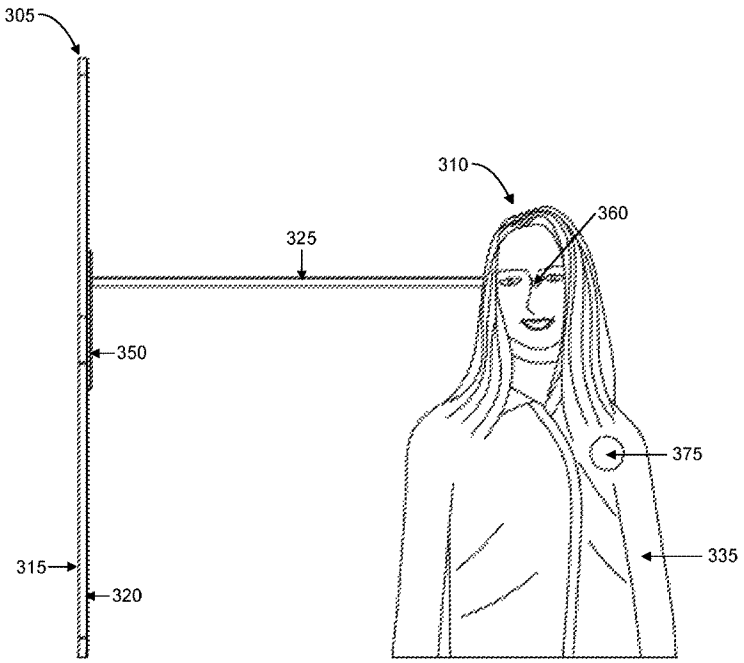
FIGS. 16A-16B and 17A-17B: Respectively, front and back side views of the configuration of FIG. 13, whereby
Figure 16A:
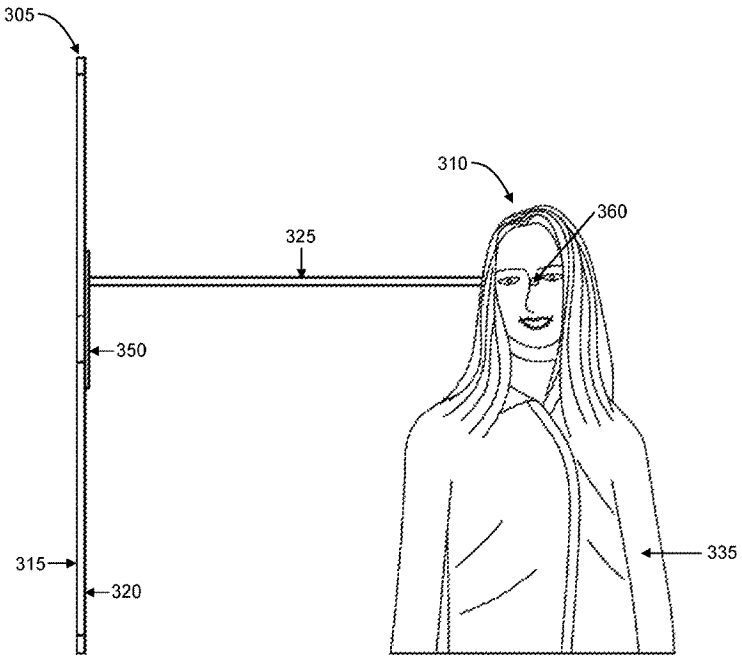
Figure 17B:
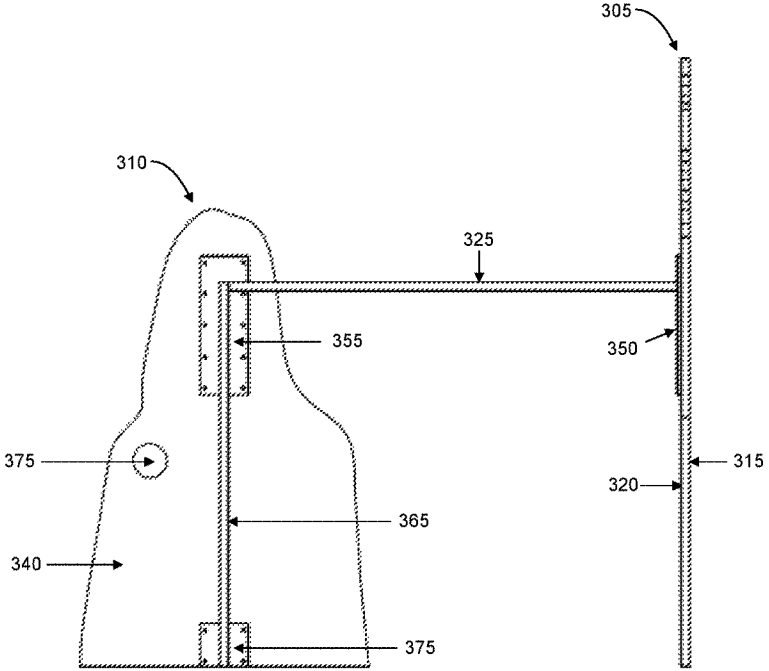
Figure 17A:
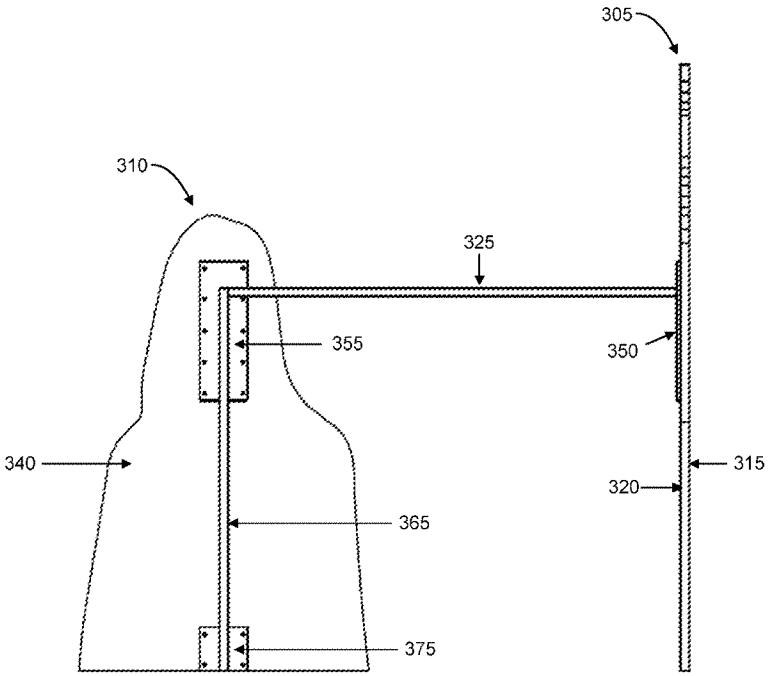

As shown in FIG. 14, the first hanger bar (325) and the second hanger bar (360) (or a single curved hanger bar) may be positioned at a height of about 30 inches to about 70 inches above the floor, preferably about 40 inches to about 65 inches above the floor, and even more preferably about 45 inches to about 62 inches above the floor.

Besides the above-described substantially parallel and perpendicular configurations, configurations of other geometries can be made using different arrangements of point of sale displays, hanger bars (or other members), and/or vertical support poles. Furthermore, the use of pivoting joints, for example on the brackets and/or hanger bars, permit arrangements where the point of sale displays and hanger bars are positioned at various angles to each other (see, e.g., FIG. 21).

While preferred embodiments have been described, it is evident that many additional modifications, variations or alternatives are apparent to the skilled artisan. The present application intends to embrace all of such modifications, variations or alternatives which fall within the scope of the invention.

What is claimed is:

1. A system comprising:

a member onto which merchandise is held for display; and a point of sale display comprising:

a first side comprising an image display; and a second side comprising a backing; and an affixed bracket for connecting the member thereto, wherein a first end of the member is connected to the point of sale display and a second end of the member is connected to a wall, whereby the merchandise is held by the member between the point of sale display and the wall, and the point of sale display supports both the member and the merchandise.

2. The system of claim 1, wherein the affixed bracket further comprises a pivoting joint.

3. The system of claim 2, wherein the point of sale display is made from wood.

4. The system of claim 1, wherein the member is a hanger bar selected from a group consisting of a straight hanger bar, a curved hanger bar, an S-shaped hanger bar, and combinations thereof.

5. The system of claim 1, wherein the member is selected from a group consisting of a hanger bar, a rod, a beam, a garment rack, shelving or combinations thereof.

6. The system of claim 1, wherein the point of sale display further comprises an aperture, wherein the aperture is selected from the group consisting of a display aperture, a hook aperture and combinations thereof.

7. The system of claim 1, wherein the image display depicts at least one image, wherein the image is selected from the group consisting of a still image, a moving image and combinations thereof.

8. The system of claim 7, wherein the image is projected onto the first side of the point of sale display.

9. The system of claim 1, wherein the backing is reflective.

10. The system of claim 9, wherein the reflective backing is selected from the group consisting of reflective foil, metalized film, mirror and combinations thereof.

11. The system of claim 1, wherein the image display depicts an image of at least one human.

12. A system comprising:

one or more horizontal members onto which merchandise is held for display;

a first point of sale display and a second point of sale display connected by and supporting the one or more horizontal members to form a free-standing structure, wherein each point of sale display comprises:

a first side comprising an image display;

a second side comprising a backing; and at least one affixed bracket for connecting the one or more horizontal members thereto;

one or more vertical poles connected to the one or more horizontal members to provide additional support to the free-standing structure; and one or more horizontal bars connected between the first and second point of sale displays to provide additional support, wherein the one of more vertical poles are further connected to the one or more horizontal bars, and wherein no merchandise is held by the one or more horizontal bars.

13. The system of claim 12, wherein the member is selected from a group consisting of a hanger bar, a rod, a beam, shelving or combinations thereof.

14. The system of claim 13, wherein the hanger bar is selected from a group consisting of a straight hanger bar, a curved hanger bar, an S-shaped hanger bar, and combinations thereof.

15. The system of claim 12, wherein the image display of each point of sale display depicts a larger than life-size image of at least one human and wherein the backing of each point of sale display is reflective.

16. The system of claim 12, wherein the first and second point of sale displays are positioned substantially perpendicular to each other.

17. The system of claim 12, wherein the first and second point of sale displays are positioned substantially parallel to each other.

18. A system comprising:

one or more horizontal members onto which merchandise is held for display;

a first point of sale display and a second point of sale display connected by and supporting the one or more horizontal members to form a free-standing structure, wherein each point of sale display comprises:

a first side comprising an image display;

a second side comprising a backing; and at least one affixed bracket for connecting the one or more horizontal members thereto;

one or more vertical poles connected to the one or more horizontal members to provide additional support to the free-standing structure; and one or more 2-dimensional multi-sided support members connected to the first point of sale display or the second point of sale display to provide additional support.

19. The system of claim 18, wherein the member is selected from a group consisting of a hanger bar, a rod, a beam, shelving or combinations thereof.

20. The system of claim 19, wherein the hanger bar is selected from a group consisting of a straight hanger bar, a curved hanger bar, an S-shaped hanger bar, and combinations thereof.

21. The system of claim 18, wherein the image display of each point of sale display depicts a larger than life-size image of at least one human and wherein the backing of each point of sale display is reflective.

22. The system of claim 18, wherein the first and second point of sale displays are positioned substantially perpendicular to each other.

23. The system of claim 18, wherein the first and second point of sale displays are positioned substantially parallel to each other.

* * * * *